US006937217B2

(12) United States Patent
Klompenhouwer et al.

(10) Patent No.: US 6,937,217 B2
(45) Date of Patent: Aug. 30, 2005

(54) DISPLAY DEVICE AND METHOD OF DISPLAYING AN IMAGE

(75) Inventors: Michiel Adriaanszoon Klompenhouwer, Eindhoven (NL); Geoffrey Lunn, Colchester (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 311 days.

(21) Appl. No.: 10/101,789

(22) Filed: Mar. 20, 2002

(65) Prior Publication Data

US 2002/0140713 A1 Oct. 3, 2002

(30) Foreign Application Priority Data

Mar. 27, 2001 (EP) ..... 01201166

(51) Int. Cl.[7] ..... G09G 3/36

(52) U.S. Cl. ..... 345/87; 345/694; 345/82

(58) Field of Search ..... 345/87, 694, 690, 345/88, 89, 764, 600, 589, 591; 358/296

(56) References Cited

U.S. PATENT DOCUMENTS

| | | | | | |
|---|---|---|---|---|---|
| 4,630,307 | A | * | 12/1986 | Cok | 382/165 |
| 4,652,912 | A | * | 3/1987 | Masubuchi | 348/803 |
| 5,341,153 | A | * | 8/1994 | Benzschawel et al. | 345/694 |
| 5,450,208 | A | * | 9/1995 | Murata | 358/296 |
| 6,624,828 | B1 | * | 9/2003 | Dresevic et al. | 345/771 |
| 2002/0084962 | A1 | * | 7/2002 | Yamaguchi | 345/87 |

* cited by examiner

*Primary Examiner*—Albert Decady
*Assistant Examiner*—Fritz Alphonse

(57) ABSTRACT

A method of displaying an image, wherein a first density of image pixels, each comprising a sub-pixel is displayed on a display having a second density of display pixels. Each display pixel has at least two spatially offset display sub-pixels. The display sub-pixels are able to display a first color and a second color, respectively. According to the invention, the image is resized to an intermediate image having a third density of intermediate image pixels, each comprising an intermediate image sub-pixel, and the display sub-pixels are displayed with a respective intensity which is determined from the corresponding intermediate image sub-pixels. This reduces the image artifacts when the display screen is used with different image standards.

15 Claims, 2 Drawing Sheets

DISPLAY DEVICE AND METHOD OF DISPLAYING AN IMAGE

The invention relates to a method of displaying an image, the method comprising a step of providing a first density of image pixels, each comprising a sub-pixel, a step of providing a display having a second density of display pixels, the second density being smaller than the first density and each display pixel comprising two spatially offset display sub-pixels being able to display a first color and a second color, respectively, and a step of displaying the display sub-pixels with an intensity which depends on the corresponding image sub-pixels.

The invention also relates to a display device for carrying out this method.

The method can be used for displaying images on Plasma Display Panels and for displaying images on very large displays with a screen diagonal of, for example, several meters. Such a large display may consist of a screen with different red, green and blue LEDs. Several different patterns can be used to distribute the LEDs on the screen. One configuration is, for example, a hexagonal configuration as shown in FIG. 2.

A method and display device as mentioned in the opening paragraph are known from U.S. Pat. No. 5,341,153. In the known method, a red display sub-pixel is displayed with an intensity which is a function of at least two red image sub-pixels extending across a first region centered at the position of the red display sub-pixel. The first region has an area which is larger than the area of the red display sub-pixel. A green display sub-pixel is displayed with an intensity which is a function of at least two green image sub-pixels, extending across a second region centered at the position of the green display pixel. The second region has an area which is larger than the area of the green display sub-pixel. A blue display sub-pixel is displayed with an intensity which is a function of at least two blue image sub-pixels, extending across a third region centered at the position of the blue display sub-pixel. The third region has an area which is larger than the area of the blue display sub-pixel. A disadvantage of this method is that the scaling factor between the first density of image pixels and the second density of display pixels may be a non-integer value. In this case, the relation between the image pixels and the red, green and blue display sub-pixels, i.e. the LED positions changes with the positions of the image pixels resulting in complex calculations or artifacts in the displayed image. Therefore, integer values of the scaling factors are selected. This limits the flexibility with respect to the resolution and/or size of the display screen given the modular building possibilities making up the LED screens and the different display standards, for example NTSC, PAL, VGA, SVGA, XVGA. A modular LED screen can be assembled with modules consisting of, for example, 32×32 LEDs.

It is an object of the invention to provide a method of displaying an image with improved image quality on the display screen having a predetermined resolution and/or size and for use with different display standards. This object is achieved by a method in accordance with the invention, which is characterized in that the method further comprises, before the step of displaying, a step of resizing the first density of first image pixels to a third density of intermediate image pixels, each comprising an intermediate image sub-pixel, and a step of determining the display sub-pixels from a predetermined number of corresponding intermediate image sub-pixels. This allows selection of suitable scaling factors for obtaining the display pixels from the intermediate image sub-pixels. A further advantage is that these scaling factors enable the step of determining the display sub-pixels from the intermediate sub-pixels to be carried out by using simple calculations. This may result in a simple hardware implementation using existing scaling circuits, which can only perform filter operations in a rectangular grid for converting the intermediate image from the image. The method as claimed allows application of a display screen with a predetermined resolution, pixel configuration and/or size for use with different video standards, which display screen can be made of several display modules consisting of a predetermined number of LEDs.

A preferred embodiment of the method in accordance with the invention is characterized in that intermediate pixels have a higher density than the display pixels. In this way, an improved resolution of the display is perceived.

A further embodiment of the method in accordance with the invention is characterized in that the display sub-pixels are arranged in a display grid and the intermediate image pixels are arranged in an intermediate grid, and the ratio between the third density and the second density is determined from an integer multiple of the minimum number of points of the intermediate grid to depict the grid corresponding to the display sub-pixels. This allows selection of the intermediate grid, so that for one selected color on optimal filter configuration can be obtained for calculating the display sub-pixels from the intermediate sub-pixels.

A further embodiment of the method in accordance with the invention is characterized in that the display sub-pixels are arranged in a hexagonal grid and the third density of intermediate pixels is an integer multiple of 3×2. For this selection of the intermediate grid, the two-dimensional filters for determining the display sub-pixels from the intermediate sub-pixels may be identical for each color of the display screen and can be performed by a single processor.

It is a further object of the invention to provide a display device for displaying an image with improved image quality on a display screen with a predetermined resolution and/or size and for use with different display standards. This object is achieved by a device in accordance with the invention, which is characterized in that the display device comprises means for resizing the first density of first image pixels to a third density of intermediate image pixels, each comprising an intermediate image sub-pixel, and in that the processing means are further arranged to determine the display sub-pixels from a predetermined number of corresponding intermediate image sub-pixels.

These and other aspects of the invention are apparent from and will be elucidated with reference to the embodiments described hereinafter.

Figure 1:
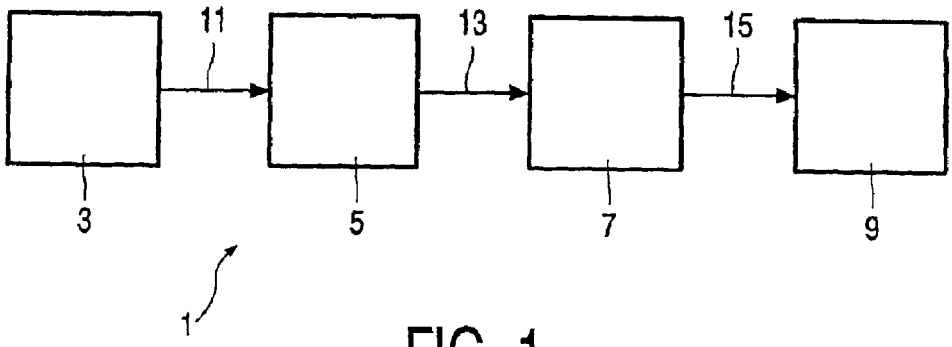
FIG. 1 is a block diagram of a LED display device.

FIG. 1 is a block diagram of a display device 1 comprising an image source 3 for providing an input image 11 comprising a first density of image pixels. The image source 3 may be a personal computer or a television. Each image pixel of the input image 11 consists of three sub-pixels in respective red, green and blue colors. The image source 3 is connected to a scaler 5 for resizing the input image with a first density of first image pixels to an intermediate image 13 with a third density of intermediate image pixels. Each intermediate image pixel comprises three intermediate image sub-pixels in the colors red, green and blue. The scaler 5 is connected to the display screen 9 via a processing means 7. The display screen 9 comprises a plurality of display pixels having a second density. Each display pixel comprises three display sub-pixels which have a spatial offset. Each display sub-pixel of a single display pixel is formed by LEDs emitting radiation in one of the respective red, green and blue colors.

Figure 2:
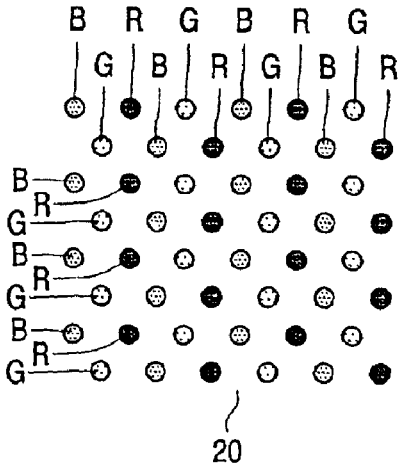
FIG. 2 shows a LED arrangement of a display screen.

FIG. 2 shows a LED arrangement 20 in a hexagonal grid. This arrangement of the red, green and blue LEDs R,G,B is referred to as the DeltaNabla arrangement.

Figure 3:
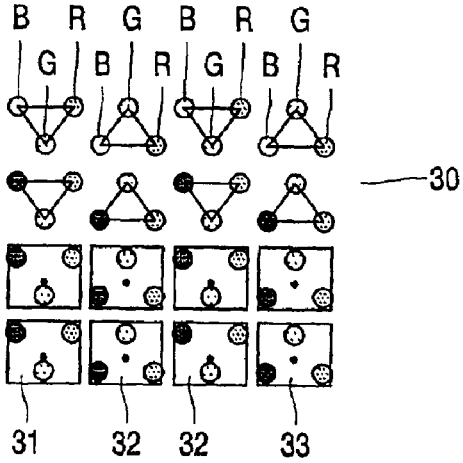
FIG. 3 shows an arrangement of LEDs in display pixels.

FIG. 3 shows an arrangement 30 of three color sub-pixels or LEDs in display pixels. The top half 30 of FIG. 3 shows the DeltaNabla arrangement of the red, green and blue LEDs R,G,B. The bottom half of FIG. 3 shows that the DeltaNabla arrangement results in a rectangular grid of display pixels 31,32,33,34. The rectangular grid may correspond to the pixels of an input image, shown in FIG. 3 as squares 31,32,33,34. However, in order to reduce costs, the red, green and blue LEDs usually have a lower density than the image pixels in the input image. There is also a spatial offset between the red, green or blue LED. This offset depends on the color of the display sub-pixel and the pixel position and may give rise to colored image artifacts. To compensate for this offset, the display sub-pixels are determined by filtering the pixels of the input image in the processing unit 7.

Furthermore, the display screen may be assembled from a number of modules consisting of, for example, 32×32 LEDs. The display screen may consist of, for example, 384 (horizontal)×288 (vertical) modules. Different combinations of these 32×32 modules allow adaptation of the resolution and/or size of the display screen 9 to different viewing conditions is both outside and inside applications.

In order to increase the flexibility of screen sizes and resolutions of the display screen, the scaler 5 resizes the input image 11 with a first density of image pixels to an intermediate image 13 with a third density of intermediate pixels. Preferably, the third density of intermediate pixels is larger than the first density of image pixels. The ratio of the third density of intermediate pixels and the second density of display pixels is an integer multiple of the minimum number of points of the intermediate grid to describe the display grid of the display screen 9 with the intermediate grid.

In a first example, the red, green and blue display sub-pixels are calculated via different two-dimensional filters from the intermediate red, green and blue sub-pixels of the intermediate image 13.

Figure 4:
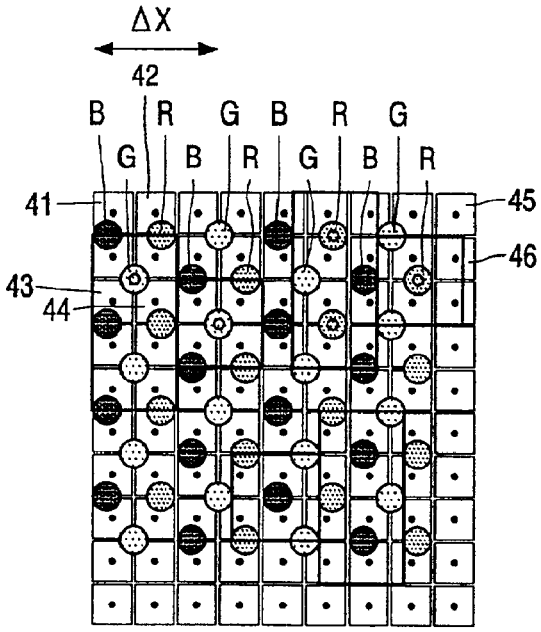
FIG. 4 shows an intermediate grid and a display grid of a first example of a display device.

FIG. 4 shows a grid of intermediate pixels 41,42,43,44, 45 and 46 and a grid of display sub-pixels R,G,B of a first example of a display screen for use in the display device 1. The grid of red, green or blue display sub-pixels R,G,B can be depicted by two rectangular intermediate grids with an offset in both orthogonal directions. In this example, the display grid of the green sub-pixels is a hexagonal grid which can be described by a single point in the X-direction and two points of the intermediate rectangular grid in the Y-direction. The display grids of the respective red and blue sub-pixels are hexagonal grids which can be described by three points of the intermediate rectangular grid in the x-direction and two points in the y-direction. The sampling functions for the respective red, green and blue display pixels are then:

$$R_{hexagonal}=R(x,y)(\Delta_{2\Delta x,\Delta y}(x-\Delta x/3,y)+\Delta_{2\Delta x,\Delta y}(x+2\Delta x/3,y))$$

$$G_{hexagonal}=G(x,y)(\Delta_{2\Delta x,\Delta y}(x,y)+\Delta_{2\Delta x,\Delta y}(x+\Delta x,y+\Delta y/2))$$

$$B_{hexagonal}=B(x,y)((\Delta_{2\Delta x,\Delta y}(x+\Delta x/3,y)+\Delta_{2\Delta x,\Delta y}(x-2\Delta x/3,y+\Delta y/2))$$

wherein $\Delta_{\Delta x,\Delta y}(x,y)$ represents a two-dimensional sampling function, x, y represent the coordinates in the display grid, and Δx, Δy represent the pitch in the respective horizontal and vertical directions in the display grid.

In this example, the pitches Δx, Δy are equal to the distance of two adjacent centers of the region occupied by the display pixel in the respective orthogonal directions.

In order to improve the picture quality, the ratio between the third density of the intermediate grid and the second density of the display grid should be an integer multiple of the number of points of the intermediate grid to depict the hexagonal grid of the display pixels with the intermediate grid. In this example, an integer multiple of 1×2 such as 2×2 or 3×2 may be used.

Figure 5:
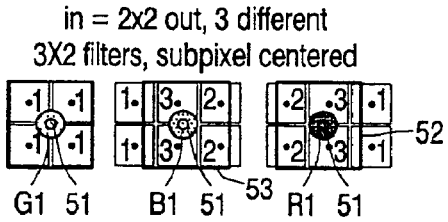
FIG. 5 shows a filter environment for the first example.

FIG. 5 shows the coefficients of the respective two-dimensional environment of the filters for obtaining the green display sub-pixel G1, the blue display sub-pixel B1 and the red display sub-pixel R1. In this example, the positions of the pixels of the intermediate grid are symmetrical with the position of the green display sub-pixel in the display grid. Therefore, the two-dimensional filter for the green display sub-pixels is centered around the sub-pixels and can be optimally chosen. The positions of the respective red and blue intermediate sub-pixels are not symmetrical with the position of the respective red and blue display sub-pixels in the display grid. Therefore, the two-dimensional filters for the respective red and blue display pixels are different. This selection of two-dimensional filter geometries leads to an improved perceived picture quality because the visual perception is more sensitive to green light.

Figure 6:
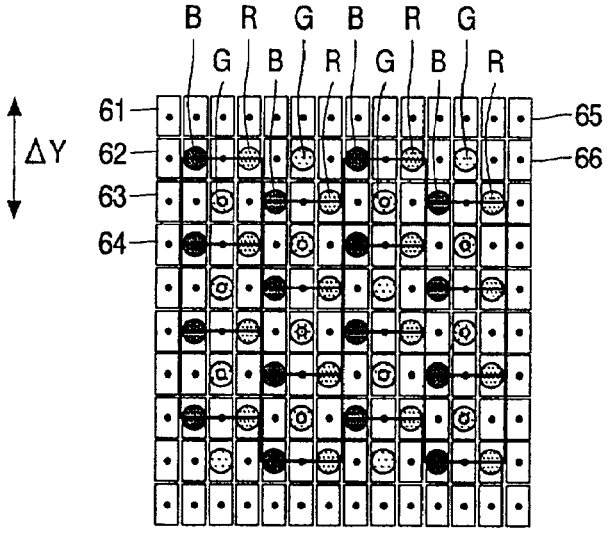
FIG. 6 shows an intermediate grid and a display grid of a second example of a display screen.

FIG. 6 shows a grid of intermediate pixels 61,62,63,64, 65 and 66 and a third grid of display sub-pixels R,G,B of a second example of a display device. In this example, the display grid is a hexagonal grid described by three points of the third intermediate grid in the x-direction and two points in the y-direction as can be derived for the RGB sampling function:

$$RGB_{hexagonal}=R(x,y)(\Delta_{2\Delta x,\Delta y}(x-\Delta x/3,y)+\Delta_{2\Delta x,\Delta y}(x+2\Delta x/3,y+\Delta y/2))$$

$$+G(x,y)((\Delta_{2\Delta x,\Delta y}(x,y)+\Delta_{2\Delta x,\Delta y}(x+\Delta x,y+\Delta y/2))+$$

$$B(x,y)((\Delta_{2\Delta x,\Delta y}(x+\Delta x/3,y)+\Delta_{2\Delta x,\Delta y}(x-2\Delta x/3,y+\Delta y/2))$$

wherein $\Delta_{\Delta x,\Delta y}(x,y)$ represents a two-dimensional sampling function, x, y represent the coordinates in the sampling grid, and Δx, Δy represent the pitch in the respective horizontal and vertical directions.

In this second example, the pitches Δx, Δy are equal to the distance of two adjacent centers of the region occupied by the display pixel.

The rectangular grid of the intermediate pixels is described by a second two-dimensional sampling function $\Delta_{\Delta x/3,\Delta y/2}(x,y)$. In this second example, the ratio of the third density of the intermediate pixels and the second density of the display pixels should be equal to an integer multiple of the number of points of the intermediate grid to depict the hexagonal display grid using the intermediate grid. The ratio between the densities of the intermediate grid and the display grid should then be an integer multiple of 3×2 such as 3×4 or 6×2.

Figure 7:
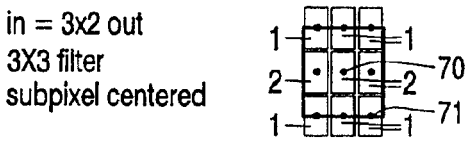
FIG. 7 shows a filter environment for the second example.

FIG. 7 shows the coefficients of the respective two-dimensional environment of the filters for obtaining the green display sub-pixel, the red display sub-pixel and the blue display sub-pixel. In this embodiment, the positions of the respective red, green and blue sub-pixels of the intermediate grid coincide with the positions of the respective red, green and blue display sub-pixels in the display grid. Therefore, the two-dimensional filters for all display sub-pixels R,G, and B may be identical and can be performed by a single processor, for example, a generally known programmable gate array. Furthermore, for the given second and third densities of the display image and the intermediate image, the positions of the red and blue sub-pixels of the intermediate grid coincide with the positions of the respective red and blue LEDs 70 in the display grid, reducing artifacts.

It should be noted that the above-mentioned embodiments illustrate rather than limit the invention, and that those skilled in the art will be able to design many alternative solutions without departing from the scope of the claims. In the claims enumerating several means, several of these means can be embodied by one and the same item of hardware. The invention is preferably applied in large-screen displays and other matrix displays (digital micro-mirrored devices, plasma display panels (PDP), PALC displays, LCD, etc.).

What is claimed is:

1. A method of displaying an image, the method comprising a step of providing a first density of image pixels, each comprising a sub-pixel, a step of providing a display having a second density of display pixels, the second density being smaller than the first density, and each display pixel comprising two spatially offset display sub-pixels being able to display a first color and a second color, respectively, and a step of displaying the display sub-pixels with an intensity which depends on the corresponding image sub-pixels, wherein the method further comprises, before the step of displaying, a step of resizing the first density of first image pixels to a third density of intermediate image pixels, each comprising an intermediate image sub-pixel, and a step of determining the display sub-pixels from a predetermined number of corresponding intermediate image sub-pixels.

2. A method as claimed in claim 1, wherein intermediate pixels have a higher density than the display pixels.

3. A method as claimed in claim 1, wherein the display sub-pixels are arranged in a display grid and the intermediate image pixels are arranged in an intermediate grid, and the ratio between the third density and the second density is determined from an integer multiple of the minimum number of points of the intermediate grid to depict the grid corresponding to the display sub-pixels.

4. A method as claimed in claim 3, wherein the display sub-pixels are arranged in a hexagonal grid and the ratio between the third density of intermediate pixels and the second density of display pixels is an integer multiple of 3×2.

5. A display device comprising means for providing a first density of image pixels, each comprising an image sub-pixel, a display screen having a second density of display pixels, which is smaller than the first density, each display pixel comprising two spatially offset display sub-pixels being able to display a first and a second color, respectively, processing means for displaying the display sub-pixels with an intensity which depends on the corresponding image sub-pixels, and means for resizing the first density of first image pixels to a third density of intermediate image pixels, each comprising an intermediate image sub-pixel, wherein the processing means are further arranged to determine the display sub-pixels from a predetermined number of corresponding intermediate image sub-pixels.

6. The display device of claim 5, wherein the intermediate pixels have a higher density than the display pixels.

7. The display device of claim 5, wherein the display sub-pixels are arranged in a display grid and the intermediate image pixels are arranged in an intermediate grid, and wherein the second density is an integer multiple of the minimum number of points of the intermediate grid to depict the grid corresponding to the display sub-pixels.

8. The display device of claim 7, wherein the display sub-pixels are arranged in a hexagonal grid and the ratio between the third density of intermediate pixels and the second density of display pixels is an integer multiple of 3×2.

9. A method of displaying an image, the method comprising:

receiving an input image comprising image pixels having a first density, each image pixel including at least one image sub-pixel;

providing a display including display pixels having a second density, the second density being less than the first density, and each display pixel comprising at least two spatially offset display sub-pixels adapted to display a first color and a second color, respectively;

converting the input image to an intermediate image comprising intermediate image pixels having a third density less than the first density, each intermediate image pixel comprising at least one intermediate image sub-pixel;

determining the display sub-pixels from a predetermined number of intermediate image sub-pixels; and displaying the display sub-pixels with an intensity which depends on the corresponding intermediate image sub-pixels.

10. The method of claim 9, wherein determining the display sub-pixels from a predetermined number of intermediate image sub-pixels includes passing the intermediate image sub-pixels through a two dimensional filter.

11. The method of claim 9, wherein each display pixel comprises a red display sub-pixel, a blue display sub-pixel, and a green display sub-pixel, and wherein each intermediate image pixel comprises a red intermediate image sub-pixel, a blue intermediate image sub-pixel, and a green intermediate image sub-pixel.

12. The method of claim 11, wherein the display sub-pixels are arranged in a display grid and the intermediate image pixels are arranged in an intermediate grid, wherein positions of the green intermediate image sub-pixels are symmetrical with respect to positions of the green display sub-pixels, and wherein positions of the red and blue intermediate image sub-pixels are not symmetrical with respect to positions of the red and blue display sub-pixels, respectively.

13. The method of claim 12, wherein determining the display sub-pixels from a predetermined number of intermediate image sub-pixels includes:

passing the green intermediate image sub-pixels through a first two dimensional filter centered around the green display sub-pixels, passing the red intermediate image sub-pixels through a second two dimensional filter that is not centered around the red display sub-pixels; and passing the blue intermediate image sub-pixels through a third two dimensional filter that is not centered around the blue display sub-pixels.

14. The method of claim 11, wherein determining the display sub-pixels from a predetermined number of intermediate image sub-pixels includes passing the green intermediate image sub-pixels, the red intermediate image sub-pixels and the blue intermediate image sub-pixels through a same two dimensional filter.

15. The method of claim 9, wherein the display sub-pixels are arranged in a hexagonal grid and the ratio between the third density of intermediate pixels and the second density of display pixels is an integer multiple of 3×2.

* * * * *